US010499714B2

(12) United States Patent
Mouche et al.

(10) Patent No.: US 10,499,714 B2
(45) Date of Patent: Dec. 10, 2019

(54) FIXING DEVICE

(71) Applicant: ETA SA Manufacture Horlogere Suisse, Grenchen (CH)

(72) Inventors: Laurent Mouche, Nidau (CH); Pascal Lagorgette, Bienne (CH); Raphael Balmer, Vicques (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 16/032,738

(22) Filed: Jul. 11, 2018

(65) Prior Publication Data

US 2019/0021456 A1 Jan. 24, 2019

(30) Foreign Application Priority Data

Jul. 21, 2017 (EP) ..... 17182614

(51) Int. Cl.

| | |
|---|---|
| ***A44C 5/14*** | (2006.01) |
| ***G04G 17/06*** | (2006.01) |
| ***G04G 17/08*** | (2006.01) |
| ***G04G 19/00*** | (2006.01) |

(52) U.S. Cl.

CPC ..... *A44C 5/14* (2013.01); *G04G 17/06* (2013.01); *G04G 17/08* (2013.01); *G04G 19/00* (2013.01)

(58) Field of Classification Search

CPC ..... A44C 5/14; G04G 19/00

See application file for complete search history.

(56) References Cited

U.S. PATENT DOCUMENTS

| | | | | |
|---|---|---|---|---|
| 5,914,913 | A * | 6/1999 | Shriqui | A44C 5/14 224/164 |
| 9,274,506 | B2 * | 3/2016 | Lu | G04G 17/02 |
| 9,768,538 | B1 * | 9/2017 | Tulloch | H01R 31/06 |
| 9,839,264 | B2 * | 12/2017 | Schooley | A44C 5/2057 |

(Continued)

FOREIGN PATENT DOCUMENTS

| | | |
|---|---|---|
| CH | 705 220 B1 | 1/2013 |
| CH | 707 313 A2 | 6/2014 |

(Continued)

OTHER PUBLICATIONS

European Search Report dated Jan. 31, 2018 in European Application 17182614.2 filed on Jul. 21, 2017 (with English Translation of Categories of Cited Documents).

*Primary Examiner* — William H. Mayo, III
*Assistant Examiner* — Hiram E Gonzalez
(74) *Attorney, Agent, or Firm* — Oblon, McClelland, Maier & Neustadt, L.L.P.

(57) ABSTRACT

The invention relates to a portable electronic device including a case and a watchband link attached to said case, the case comprising a pair of horns, between which is disposed a female electrical connector, the link comprising a male electrical connector disposed at the end of the link and adapted to make an electrical connection with the female electrical connector when the link is mounted on the case. According to the invention, each horn comprises a bar intended to come to be housed in an opposite housing of the watchband, the bars engaging successively in a guide groove and then in a locking groove formed in the link, the device comprising a manual actuation member for moving the bars into a retracted position.

11 Claims, 1 Drawing Sheet

(56) References Cited

U.S. PATENT DOCUMENTS

| | | | | |
|---|---|---|---|---|
| 2004/0084200 | A1 | 5/2004 | Noirjean | |
| 2007/0064542 | A1 * | 3/2007 | Fukushima ..... | G04B 37/1486<br>368/282 |

FOREIGN PATENT DOCUMENTS

| | | | |
|---|---|---|---|
| CN | 104850002 | | 8/2015 |
| EP | 1 416 582 | A1 | 5/2004 |
| JP | 57-7318 | U | 1/1982 |
| JP | 60-104787 | U | 7/1985 |
| JP | 63-126888 | U | 8/1988 |

* cited by examiner 1
2
3
4
5
6
7
30
40
41
42
43
44
45
46
60
61
62
63
70
71
400
440
h
A
B

FIXING DEVICE

This application claims priority from European Patent Application No. 17182614.2 filed on Jul. 21, 2017; the entire disclosure of which is incorporated herein by reference

FIELD OF THE INVENTION

The present invention concerns a portable electronic device comprising means for connecting a watchband to a watch case including an electrical connector. To be more precise, the present invention concerns a portable device of this kind including means enabling a reliable and sealed electrical connection to be established between a watch case and a watchband in a removable manner.

BACKGROUND OF THE INVENTION

There are known in the prior art watches that are retained on the wrist of the user by means of a watchband including a connector inserted in the case. This watchband may be made of rubber, plastic, or metal and connected to the case of the watch between the horns via fixing means such as screws for example.

There may also be provided on the watch a connector element for effecting a transfer of data. This connector element may take the form of a connector of the USB type for plugging into a computer, a male type USB connector of this type may be situated at a closure end of a branch of a watch watchband as described in the U.S. Pat. No. 7,006,408. It is therefore difficult to protect or to conceal the connector, and to change the watchband.

There is also known from the patent EP 1 416 852 a portable device including a case in which is disposed a first electrical module, and a watchband attached to the case, a second electrical module being associated with the watchband together with electrical connection means providing an electrical connection between the first and second electrical modules via an opening provided in the case. An embodiment of this kind renders changing the watchband laborious, the latter being screwed to the watch case.

SUMMARY OF THE INVENTION

A particular objective of the invention is to palliate the various drawbacks of these known techniques.

To be precise, an objective of the invention is to provide a watchband watch provided with an electrical connector on the watchband for access to an electronic circuit inside the watch, which is of simple design, and the watchband of which is easily interchangeable whilst guaranteeing a good seal at the connector.

These objectives, together with others that will become more clearly apparent hereinafter, are achieved in accordance with the invention with the aid of a portable electronic device including a case and a watchband attached to said case, the case comprising at least one pair of horns, between which is disposed a female electrical connector, the watchband comprising a male electrical connector disposed at the end of the watchband link and adapted to make an electrical connection with the female electrical connector when the watchband is mounted on the case.

According to the invention, each horn comprises a spring bar intended to come to be housed in an opposite housing of the link, the bars being able to occupy two positions, an engagement position in which they extend to the exterior of the horns to be engaged successively in a guide groove of the watchband and then in a locking groove formed in the watchband, and a retracted position, the device comprising a manual actuation member for moving the bars into their retracted position.

According to other advantageous variants of the invention:

- the guide groove and the locking groove are separated by a partition;
- the guide groove is a horizontal groove comprising a ramp for progressively loading the bars;
- the locking groove is a vertical groove;
- the end of the bars is spherical;
- the actuation member comprises two blades passing through grooves formed under the watchband and leading into the locking grooves, each blade having at its lower end an inclined cam surface adapted to cooperate with the spherical end of the bars;
- the male connector comprises a seal over all or part of its perimeter, at its exterior periphery, the seal being adapted to rest against the middle;
- the male connector is disposed in a housing formed in the watchband on the side of the internal face and at the level of the fixing of the watchband to the middle;
- the watchband is made of plastic material.

BRIEF DESCRIPTION OF THE DRAWINGS

Other features and advantages of the invention will become more clearly apparent on reading the following description of one particular embodiment of the invention, given by way of illustrative and nonlimiting example only, and from the appended figures, in which.

DETAILED DESCRIPTION OF PREFERRED EMBODIMENTS

Figures 1, 2, 3, 4, 5:
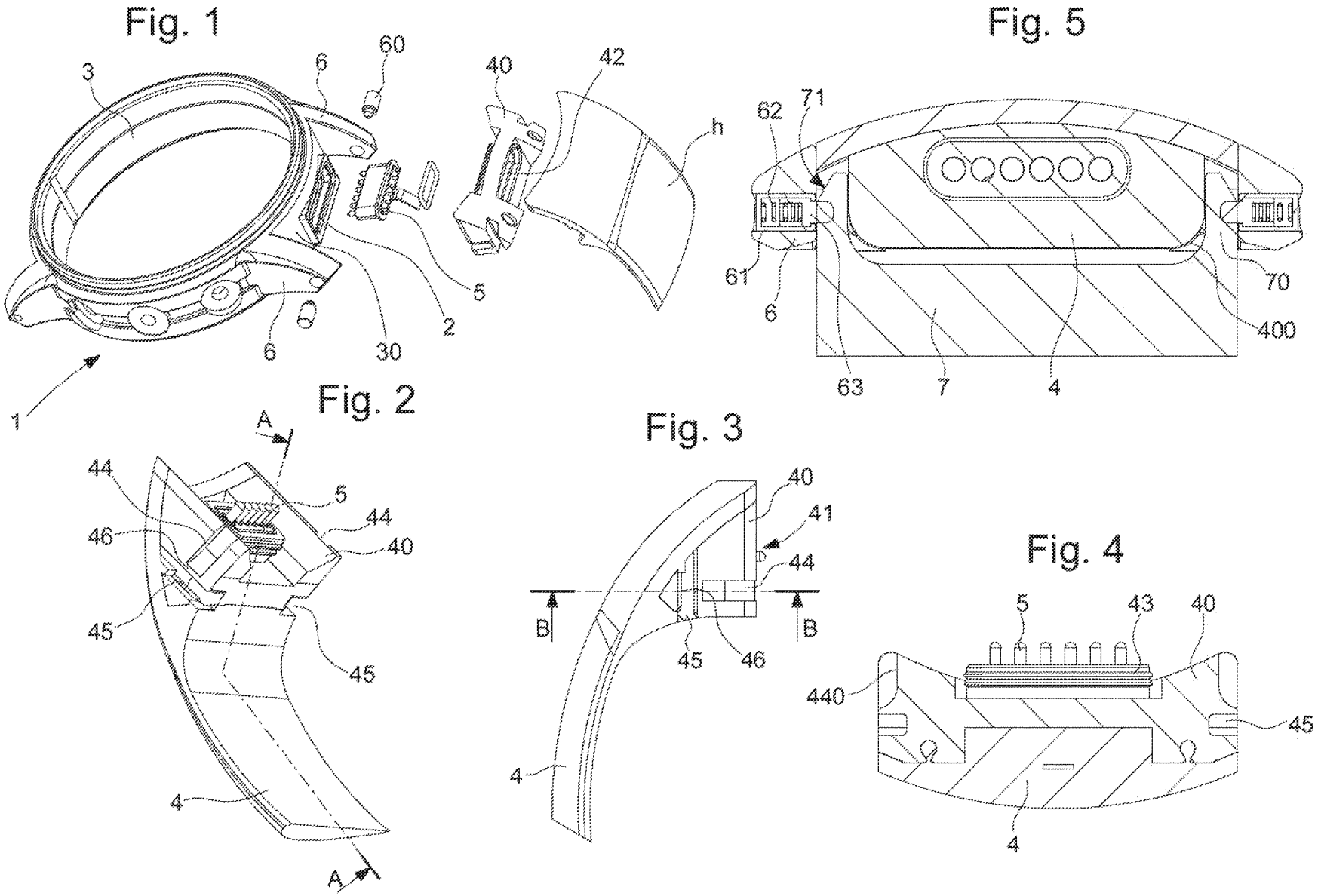
FIG. 1 is an exploded perspective view of a portable electronic device according to the invention.
FIG. 2 is a perspective view of a watchband according to the invention.
FIG. 3 is a view of the watchband from FIG. 2 in section taken along the line A-A.
FIG. 4 is a view in section taken along the line B-B in FIG. 3.
FIG. 5 is a view in section taken along the line A-A in FIG. 2, with the actuation member inserted to detach the watchband.

A portable electronic device according to the invention will now be described hereinafter with conjoint reference to FIGS. 1, 2, 3, 4 and 5.

FIG. 1 shows an exploded perspective view of the portable electronic device, here an electronic or electromechanical watch. The watch is provided with a female electrical connector 2 disposed in the middle 3 of the watch, via an opening, between the horns 6 of the middle 3.

The watchband may be composed of two links 4 with a folding buckle or traditional clasp closure. In the example shown in FIG. 1, the links of the watchband are obtained by moulding plastics materials. As shown in the figures, at least one link 4 comprises at its end intended to be in bearing engagement with the middle 3 an insert 40 also obtained by moulding plastic materials. This insert 40 is removably fixed to the link 4 or overmoulded to facilitate the installation of a male electrical connector 5 adapted to cooperate with the female electrical connector 2.

The insert 40 is adapted to be fixed to the middle 3 of the case 1 and comprises an exterior wall 41 bearing against the exterior surface 30 of the middle 3 of the case to hold it fixed without being able to turn. At least a part of the wall 41 preferably bears integrally against a part of the exterior surface 30 of the middle. The exterior surface 30 may be plane or may define a cylinder portion. The exterior wall 41 has a shape complementary to the exterior surface 30 of the middle 3 so as to bear completely against this exterior surface 30.

The inset 40 of the link 4 comprises a male electrical connector 5, the male connector exiting the insert 40 via a projecting conduit 42, at the level of the exterior wall 41, and having dimensions similar to those of the connector to ensure a good fit of the connector in the conduit 42. This male electrical connector 5 is adapted to be connected into the female electrical connector 2 of the middle during assembly of the watchband link 4 to the middle 3.

The conduit 42 comprises, at its periphery, a seal 43 extending over all or part of its perimeter, the seal 43 being adapted to rest against the middle. Because of this, the dimensions of the female connector are preferably chosen to be slightly greater than those of the conduit 42. The seal 43 is therefore housed with friction in the female socket and provides the seal between the male and female connectors. The seal 42 may be a single or double seal as shown in the FIG. 4 sectional view.

According to the invention, each horn 6 comprises a spring bar 60 formed by a body 61 receiving elastic return means, such as a spring 62 for example, acting on a pivot 63 mounted to be mobile inside the body 61. The pivot 63 is mobile along the longitudinal axis of the body and is able to move between a compressed position and a rest position in which the pivot 63 is adapted to rest in a housing formed in the watchband link.

The pivots form fixing means and project at the level of the lateral walls of the horns, to be able to cooperate with grooves of the watchband link when the link is fixed to the watch case 1.

Each pivot 63 comprises a spherical end providing good guidance in movement in translation in the grooves formed inside the watchband link, as can be seen in FIG. 2.

The pivots 63 may be made of plastic materials, ceramic, composite materials or metal or metal alloy.

These pivots are adapted to cooperate with the watchband link, and to be more precise with grooves formed in the insert 40. To this end, the insert 40 comprises a guide groove 44 and a locking groove 45 provided in the insert 40, these grooves are in particular visible in FIGS. 1 and 2.

As can be seen, the guide groove 44 is a horizontal groove comprising a ramp 440 for progressively loading the bars. The guide groove 44 leads onto the face of the insert 40 that is in contact with the middle 3 and onto the lateral face of the insert 40, the latter extending along the edge of the insert 40 over a length less than the distance between the bar and the edge of the middle.

The locking groove 45 is a vertical groove that leads onto the lower face of the insert 40, namely the face in contact with the wrist of the wearer, and onto the lateral face of the insert 40 of the watchband link.

An orifice could equally well be imagined instead and in place of the locking groove 45, the dimensions of the orifice then being slightly greater than those of the pivot 63 in order to receive it.

The guide groove 44 and the locking groove 45 are advantageously separated by a partition 46, so that the pivot of the bar is progressively compressed as far as the partition thanks to the ramp 440, after which it is lodged in the locking groove 45 and expands again when the partition 46 has been passed.

The guide groove 44 and the locking groove 45 may be machined directly in the insert of the watchband link or formed during the moulding of the insert 40.

The insert 40 of the watchband link also comprises, on its lower face, two grooves 400 configured to receive an actuating member 7, so that the pivots 63 are visible and accessible to the actuation member 7 through these grooves 400.

As can be seen in FIG. 5, the actuation member 7 comprises two blades 70 connected by a crossmember, each blade 70 having at its lower end an inclined surface 71 that cooperates with the end of the pivots 63.

Accordingly, by exerting pressure simultaneously on each of the pivots 63 by means of the actuation member 7, the pivots return to the compressed position so as to enable demounting of the watchband link 4.

This actuation member 7 is advantageously attached to a watchband clasp in such a manner that the wearer is able to detach the watchband link at any time.

According to a variant of the invention, the locking grooves 45 of the horns 6 and the bars 60 are slightly offset, so as to offset the grooves slightly relative to the bars 60, which makes it obligatory to press the insert 40 forcibly against the watch case thanks to elastic deformation of the plastic material insert, and therefore automatically to eliminate the play between the insert 40 and the middle 3.

The link 4 is mounted on the case 1 as follows.

To begin with the link, and to be more precise the insert 40, is positioned facing the middle and between the horns 6.

To this end, the pivots 63 of the bars are placed in each of the guide grooves 44 of the insert 40.

The insert 40 of the link 4 is then pushed until the male connector lies at the entry of the female connector, the pivots 63 then arriving at the end of the ramp 440 of the guide groove, and therefore in the vicinity of the partition 46.

The insert 40 of the link 4 is then pushed forcibly until the male connector is totally inserted in the female connector, which also has the effect of causing the pivots 63 to pass behind the partition 46, in the locking grooves.

The link 4 can then be released, the latter being correctly held in place by the bars and the connectors.

To detach the link 4 from the middle 3, it suffices to insert the actuation member 7 in the bottom openings of the locking grooves 45, as shown in FIG. 5, the two blades 70 passing through the bottom openings provided under the insert 40 and leading into the locking grooves 45, each blade 70 having at its lower end an inclined surface 71 that comes to bear progressively on the spherical ends of the pivots 63 until the bars 6 are totally compressed.

It goes without saying that the present invention is not limited to the embodiment that has just been described and that various modifications and simple variants may be envisaged by the person skilled in the art without departing from the scope of the invention as defined by the claims appended to the present patent application. In particular, it will be understood that although having been described in connection with a plastic material watchband link, the present invention may be applied in exactly the same way to links produced in another hard material such as metal, ceramic, or again composite material.

What is claimed is:

1. A portable electronic device comprising:

a case includes a female electrical connector between at least one pair of horns;

a watchband link includes a male electrical connector disposed at an end of the watchband link, the watchband link being configured to connect with the female electrical connector electronically when the watchband link is mounted on the case; and a manual actuation member for detaching the watchband link from the case, wherein each horn includes a spring bar configured to be housed in an opposite housing of the watchband link when the watchband link is mounted, and wherein, when mounting the watchband link on the case, the spring bar is extended from the horn into a guide groove and a locking groove of the watchband link, and when detaching the watchband link from the case, the manual actuation member is configured to compress the spring bar into a retracted position and extract the spring bar from the guide groove and the locking groove of the watchband link.

2. The portable electronic device according to claim 1, wherein the watchband link further includes a partition separating the guide groove and the locking groove.

3. The portable electronic device according to claim 1, wherein the guide groove is a horizontal groove including a ramp for progressively loading the spring bar.

4. The portable electronic device according to claim 3, wherein the locking groove is a vertical groove.

5. The portable electronic device according to claim 1, wherein an end of the spring bar is spherical.

6. The portable electronic device according to claim 1, wherein the actuation member includes two blades passing through respective bottom openings of the locking grooves formed under a lower face of the watchband link and the openings leading into respective locking grooves of the watchband link, a lower end of each blade including an inclined surface configured to cooperate with an end of the spring bar when compressing the spring bar.

7. The portable electronic device according to claim 1, wherein the male electrical connector is disposed in a conduit of the watchband link, the conduit being placed on an exterior wall of the watchband link, the exterior wall being in contact with an exterior surface of the case when the watchband link is mounted.

8. The portable electronic device according to claim 7, wherein the conduit includes a seal at an exterior periphery of the conduit, the seal being configured to rest against the case when the watchband link is mounted.

9. The portable electronic device according to claim 1, wherein the watchband link further includes a removably mounted insert, said removably mounted insert including the guide groove and the locking groove.

10. The portable electronic device according to claim 9, wherein the watchband link and the removably mounted insert are made of plastic material.

11. The portable electronic device according to claim 1, wherein the watchband link is made of plastic material.

* * * * *